US011242690B2

(12) United States Patent
Titcomb et al.

(10) Patent No.: US 11,242,690 B2
(45) Date of Patent: Feb. 8, 2022

(54) LOOP TIE FOR CONCRETE FORMING PANEL SYSTEMS

(71) Applicant: Titcomb Brothers Manufacturing, Inc., Westport, MA (US)

(72) Inventors: Paul S. Titcomb, Providence, RI (US); Ted Titcomb, Cotuit, MA (US)

(73) Assignee: Titcomb Brothers Manufacturing, Inc., Westport, MA (US)

( * ) Notice: Subject to any disclaimer, the term of this patent is extended or adjusted under 35 U.S.C. 154(b) by 0 days.

(21) Appl. No.: 16/748,620

(22) Filed: Jan. 21, 2020

(65) Prior Publication Data

US 2020/0157826 A1 May 21, 2020

Related U.S. Application Data

(63) Continuation-in-part of application No. 16/252,281, filed on Jan. 18, 2019, now Pat. No. 10,907,365.

(60) Provisional application No. 62/794,429, filed on Jan. 18, 2019, provisional application No. 62/619,545, filed on Jan. 19, 2018.

(51) Int. Cl.
*E04G 17/07* (2006.01)
*B29C 70/86* (2006.01)

(52) U.S. Cl.
CPC ..... *E04G 17/0721* (2013.01); *E04G 17/0742* (2013.01)

(58) Field of Classification Search
CPC . E04G 17/0721; E04G 17/06; E04G 17/0742; E04G 17/0758; E04G 17/045; E04G 17/0754; E04G 17/07; E04G 17/0707; E04G 17/0728; E04G 17/075; E04G 17/0751; E04G 17/0755; B29C 70/86
See application file for complete search history.

(56) References Cited

U.S. PATENT DOCUMENTS 371,665 A 10/1887 Brinkerhoff
1,020,916 A 3/1912 Lanier
(Continued)

FOREIGN PATENT DOCUMENTS

DE 102010013960 A1 10/2011
EP 0278803 A1 8/1988
(Continued)

OTHER PUBLICATIONS

Chinese Office Action, CN Application No. 2019800092184, dated Jul. 21, 2021, 12 pages.
(Continued)

*Primary Examiner* — Michael Safavi
(74) *Attorney, Agent, or Firm* — Nelson Mullins Riley & Scarborough LLP; Anthony A. Laurentano

(57) ABSTRACT

A tie rod suitable for use with a concrete forming system, comprising one or more button rod elements, wherein the button rod element has an elongated main body having a first end region having a head portion, an opposed second end region having an anchor portion, and an intermediate region, wherein the second end region or the intermediate region has one or more relatively flat cut-outs formed therein. The tie rod also includes a continuous fiber wound about the anchor point and the cut-outs to form the tie rod.

20 Claims, 16 Drawing Sheets

(56) References Cited

U.S. PATENT DOCUMENTS 1,257,827 A * 2/1918 Emmons ..... E04G 17/0754 249/215
1,311,036 A * 7/1919 Birch ..... E04G 17/0714 249/43
1,429,412 A 9/1922 Davidson
1,518,955 A * 12/1924 Backlund ..... E04G 17/0658 249/215
1,540,570 A 6/1925 Lud
1,552,334 A 9/1925 Mosher
1,577,343 A * 3/1926 Miller ..... E04G 17/0754 249/215
1,594,973 A 8/1926 Moser
1,615,338 A 1/1927 Moser
1,648,995 A * 11/1927 Phillips ..... E04G 17/0754 24/269
1,664,152 A * 3/1928 Beghetti ..... E04G 17/06 249/215
1,684,136 A * 9/1928 Lynch ..... E04G 17/0754 249/190
1,925,221 A 9/1933 Wotnoske
1,931,834 A 10/1933 Wotnoske
1,987,076 A 1/1935 Oscar
2,003,225 A * 5/1935 Vrooman ..... F16G 11/14 174/141 R
2,614,058 A * 10/1952 Francis ..... B29C 70/326 156/171
2,732,606 A * 1/1956 Wheeler ..... E04G 17/0658 249/215
2,959,835 A * 11/1960 Gordon ..... E04G 17/06 249/215
2,977,406 A * 3/1961 Scott ..... H01B 17/12 174/177
3,010,494 A 11/1961 Horace
3,111,569 A * 11/1963 Rubenstein ..... B28B 23/0006 52/223.14
3,222,858 A * 12/1965 Gilmore ..... D07B 1/18 57/201
3,301,931 A 1/1967 Morin
3,362,252 A * 1/1968 Ditlinger ..... F16C 7/026 74/579 R
3,370,483 A * 2/1968 Ditlinger ..... B64C 27/327 74/579 R
3,411,742 A * 11/1968 McArdle ..... E04G 17/0721 249/205
3,422,586 A * 1/1969 Domenico ..... E04G 21/12 52/223.14
3,457,962 A * 7/1969 Shobert ..... D04C 1/02 138/144
3,460,628 A * 8/1969 Tankersley ..... F16C 7/026 416/213 R
3,513,609 A * 5/1970 Lang ..... E04C 5/08 52/223.6
3,571,492 A * 3/1971 Clark ..... H01B 17/12 174/178
3,601,356 A 8/1971 Yurick
3,628,762 A 12/1971 Williams et al.
3,668,740 A * 6/1972 Pearson ..... B29C 70/347 24/16 PB
3,692,361 A * 9/1972 Ivarsson ..... B60R 22/22 297/482
3,782,220 A * 1/1974 Ditlinger ..... F16C 7/026 74/579 R
3,785,610 A 1/1974 Dagiel
3,795,380 A 3/1974 Turner
3,917,216 A 11/1975 Plough
3,923,278 A 12/1975 Marcil
3,970,495 A * 7/1976 Ashton ..... B29C 33/52 156/162
3,978,626 A * 9/1976 Weinar ..... E04B 2/58 52/127.3
4,098,480 A 7/1978 Neumann
4,103,854 A 8/1978 Pliml et al.
4,119,344 A * 10/1978 Kondo ..... B60R 22/22 24/265 EE
4,183,261 A * 1/1980 Eiselbrecher ..... B29C 53/564 74/579 R
4,205,815 A 6/1980 Sauer et al.
4,353,267 A * 10/1982 Robert ..... B29C 53/564 74/579 R
4,367,819 A 1/1983 Lewis
4,545,163 A * 10/1985 Asselin ..... E04G 17/06 249/213
4,569,190 A * 2/1986 Gilmore ..... B60R 22/22 297/468
4,832,298 A 5/1989 Metcalf
4,992,313 A * 2/1991 Shobert ..... B29C 53/582 428/36.1
5,154,388 A 10/1992 Magaro
5,181,683 A 1/1993 Smith
5,209,039 A 5/1993 Boeshart
5,215,616 A * 6/1993 Fillar ..... B65G 17/38 156/169
5,374,780 A * 12/1994 Pazdirek ..... B29C 70/347 174/137 A
5,406,033 A * 4/1995 Pazdirek ..... B29C 70/347 174/167
5,768,847 A * 6/1998 Policelli ..... B29C 53/66 156/172
5,899,035 A 5/1999 Waalkes et al.
5,924,262 A * 7/1999 Fawley ..... B32B 5/28 156/71
6,209,279 B1 * 4/2001 Meier ..... E04B 1/41 52/223.14
6,315,489 B1 11/2001 Watanabe
6,324,940 B1 * 12/2001 Pazdirek ..... B29C 53/585 174/47
7,014,155 B1 3/2006 Schnabel et al.
7,056,463 B2 * 6/2006 Ohta ..... B28B 23/043 156/162
7,201,355 B1 4/2007 Zien et al.
7,497,344 B2 3/2009 Chen
8,281,537 B2 10/2012 O'Shea et al.
8,667,754 B2 * 3/2014 Schalla ..... B29C 70/222 52/362
8,679,275 B2 * 3/2014 Schalla ..... F16C 7/02 156/169
8,777,162 B2 * 7/2014 Benthien ..... B64C 1/064 244/131
9,259,878 B2 * 2/2016 Valembois ..... B29C 53/564
9,523,178 B2 * 12/2016 Ferraiolo ..... E02D 5/80
10,493,703 B2 * 12/2019 Yasui ..... B64C 13/30
10,907,365 B2 2/2021 Titcomb et al.
2002/0047073 A1 4/2002 Deciry et al.
2003/0197102 A1 10/2003 Lin
2005/0056749 A1 3/2005 Simard
2005/0230577 A1 10/2005 Chen
2006/0019759 A1 1/2006 Shiao et al.
2012/0211609 A1 8/2012 Mandic
2015/0136924 A1 5/2015 Lachance
2016/0089820 A1 * 3/2016 Schinkinger ..... B29C 70/521 264/172.11
2019/0226219 A1 7/2019 Titcomb et al.
2019/0226513 A1 7/2019 Ubinana Felix

FOREIGN PATENT DOCUMENTS

EP 0595309 A2 5/1994
FR 2544775 A2 * 10/1984 ..... E04G 17/0721
NL 9101666 A * 5/1993 ..... E04G 17/07
WO 2016189182 A1 12/2016

OTHER PUBLICATIONS

International Search Report and Written Opinion, PCT/US2019/014286, dated Jul. 30, 2019, 8 pages.

* cited by examiner

LOOP TIE FOR CONCRETE FORMING PANEL SYSTEMS

RELATED APPLICATION

The present application claims priority to provisional patent application Ser. No. 62/794,429, filed Jan. 18, 2019, entitled LOOP TIE FOR CONCRETE FORMING PANEL SYSTEMS, and is a continuation-in-part patent application of U.S. patent application Ser. No. 16/252,281, filed Jan. 18, 2019, and entitled LOOP TIE FOR CONCRETE FORMING PANEL SYSTEMS, which in turn claims priority to U.S. provisional patent application Ser. No. 62/619,545, entitled LOOP TIE FOR CONCRETE FORMING PANEL SYSTEMS, filed on Jan. 19, 2018, the contents of which are herein incorporated by reference.

BACKGROUND OF THE INVENTION

Conventional concrete walls may be created by pouring concrete into a suitable concrete form. As is known in the art, concrete foundation walls are generally poured between two sets of concrete forms disposed in essentially parallel relationship and defining therebetween a channel having a dimension for the desired thickness of the concrete wall. Such opposed, spaced apart walls are generally held in a fixed relationship relative to each other against the immense weight of any poured concrete by tie-wires and turnbuckle assemblies having abutment surfaces against which a locking or latching arm on adjacent form sections abut. Once assembled into the shape of the wall, wet concrete is poured into the channel formed between the concrete forms and allowed to dry. The concrete forms typically comprise multiple form panels, which may for example be formed of wood, metal or any other suitable well known material. The height of the form panel may vary by application.

Multiple form panels may be placed side-by-side in order to construct a wall of a desired length. Because the wet poured concrete takes the shape of the forms in which it is placed, the finished concrete wall corresponds in configuration to the assembled form. Therefore, it is important to align precisely the panels composing the concrete form in order to ensure that the finished wall has the desired appearance and strength.

The concrete forming systems can also employ tie-rods that are disposed between aligned panels in order to keep the panels properly spaced apart and to ensure that the panels are coupled to each other in a secure manner. The tie rods extend through openings formed in the spaced apart form panels and hold the sections against relative movement toward each other. The tie-rods may extend outwardly of the sections by a selected amount as is known in the art. The portion of the tie-rods that extend beyond the panel forms typically include a flattened or coined section that is adapted to engage with the latch that is coupled to the panel bar. Once the concrete is poured between the panel forms and allowed to cure, the portion of the tie rods that extend beyond the concrete walls can be snapped off.

Conventional tie rods are typically formed of metal, such as steel. However, the prior art has also designed systems that employ fiberglass ties in the shape of linear rods. The fiberglass tie rods are typically formed of fiberglass fibers that are all essentially disposed parallel to each other and hence extend in a longitudinal direction. The rods can be coupled to the concrete forms according to known techniques. According to a first known system and method, the fiberglass tie rods can have a thread formed thereon so as to accept a corresponding fastening nut. A drawback of these types of rods is that it is expensive to grind the threads into the finished rod, and the fastening nuts can be difficult to attach at times.

According to another known system and method, the fiberglass rod can be secured to the form panels using complex and expensive fastening hardware. The hardware can include a bearing plate, a tensioning nut, and a barrel and jaw assembly that employs a wedge shaped gripper to grip the exposed end of the tie rod. A drawback of this type of hardware is that it is expensive, labor intensive, prone to rusting, and over time can be difficult to use. Further, the hardware when removed typically needs to be cleaned and maintained in order to remove excess concrete therefrom.

Another form of non-metallic tie used a fiberglass strip similar in form to conventional metal flat ties. However, a drawback of ties of this type are that they are significantly lower in strength relative to conventional metal ties, and leaves a larger exposed end in the face of the wall when the exposed portion of the tie is removed. Further, these types of ties have poor water sealing capabilities and make it difficult to user a water stopping element, such as round rubber washer.

SUMMARY OF THE INVENTION

The present invention is directed to a tie rod, such as a loop tie rod, suitable for use with known concrete forming systems. The tie rod is constructed from a non-metal fiber, such as fiberglass, that is wound about a pair of opposed thimble elements. The resultant tie rod is as strong as metal tie rod without the drawbacks of conventional metal tie rods. The tie rod of the present invention has selected advantages over conventional metal tie rods. For example, the fiberglass tie rod creates a thermal break between the end portions of the tie rod. Also, non-metal fiber, such as fiberglass, has thermal expansion characteristics that are more closely matched with concrete, such that the concrete bonds better to the tie rod of the present invention. This prevents or significantly reduces water pathways that may develop between opposite wall surfaces of the concrete wall.

The tie rod of the present invention is suitable for use with concrete forming systems and include first and second thimble elements, a continuous fiber wound between the first and second thimble elements to form the tie rod, wherein each of the thimble elements has a main body having a channel formed in an outer surface of the main body, and wherein the fiberglass fiber is disposed within the channel when wound thereabout. The fiber is wound about the thimble element a selected number of times ranging between about 8 times and about 35 times.

The channel in the thimble elements has a width of between about 0.175 inches and about 0.22 inches, and is preferably about 0.20 inches. The main body of the tie rod has a generally horse-shoe shape, which has ether an open or a closed end. The main body can also include an optional tab portion that extends outwardly therefrom from one end and one side surface of the thimble element. The tab portion is preferably located at a position opposite a closed end of the main body. The outer surface of the main body of the tie rod has the channel formed therein and includes an opposed inner surface. The inner surface can include an optional fin element.

The continuous fiber of the present invention can be formed of fiberglass, and can be optionally coated with a curing agent. The curing agent can comprise an epoxy resin material.

The present invention can also be directed to a method of forming a tie rod suitable for use with a concrete forming system. The method can include providing first and second thimble elements, wherein each of the thimble elements has a main body having a channel formed in an outer surface thereof, winding a continuous fiber between the first and second thimble elements such that the fiber is disposed within the channel of each thimble element to form an uncured tie rod, curing the uncured tie rod to form a cured tie rod, and placing the cured tie rod under tension for a selected period of time to form the tie rod.

The step of curing the uncured tie rod comprises heating the uncured tie rod for a selected period of time. The step of heating can further comprise heating the uncured tie rod for between about 1 and about 2 hours, and at a temperature of between about 250° F. and about 300° F.

The present invention can also include the step of optionally coating the fiber with a curing agent. Optionally, the fiber is pre-coated with a curing agent prior to winding the fiber about the first and second thimbles.

The present invention also contemplates a tie rod suitable for use with a concrete forming system, comprising one or more thimble elements having a main body having opposed first and second surfaces, a central channel formed along an outer peripheral surface of the main body, and wherein each of the first and second outer surfaces has an outer channel formed therein. A continuous fiber is wound about the thimble element to form the tie rod, and the thimble element is disposed at a first end of the tie rod and the continuous fiber is disposed within the central channel when wound thereabout. The fiber can be wound about the one or more thimble elements a selected number of times ranging between about 8 times and about 35 times. At the opposed second end of the tie rod can be another thimble element or a button rod element.

The main body of the tie rod has a generally horse-shoe shape and has a closed end region. The main body can also include a tab portion that extends outwardly therefrom from one end of the thimble element. The tab portion is located at a position opposite the closed end of the main body.

The main body of the one or more thimble elements has a central opening, and a solid component can be mounted within the central opening for coupling to transition hardware, such as for example a coil tie. A second thimble element can be disposed at a second end of the tie rod. Alternatively, a button rod element can be disposed at a second end of the tie rod.

According to the teachings of the present invention, the button rod element has a main body having a first end region having a head portion, an opposed second end region having an anchor point and an intermediate region, wherein the second end region or the intermediate region has a plurality of spaced apart cut-outs formed therein. Each of the cut-outs has a relatively flat top surface and/or a relatively flat bottom surface. The anchor point of the second end terminates in a star pointed end region.

Alternatively, the button rod can have a main body having a first end region, an opposed second end region having a bulbous portion, and an intermediate region having one or more cut-outs formed therein. The intermediate region has opposed relatively flat top and bottom surfaces, and the anchor portion of the bulbous portion has a flared end section having a plurality of flared legs.

The present invention is also directed to a tie rod suitable for use with a concrete forming system, comprising one or more button rod elements, wherein the button rod element has an elongated main body having a first end region having a head portion, an opposed second end region having an anchor portion, and an intermediate region, wherein the second end region or the intermediate region has one or more relatively flat cut-outs formed therein; a continuous fiber wound about the button rod element to form the tie rod; and wherein the button rod element is disposed at a first end of the tie rod and the continuous fiber is wound about the anchor point and the cut-outs.

The main body of the button rod element has a plurality of spaced apart cut-outs formed therein, wherein each of the plurality of cut-outs has a relatively flat top surface and/or a relatively flat bottom surface. The anchor point of the second end region comprises a star pointed end region. Alternatively, the second end region can have a bulbous portion, and the intermediate region has a plurality of spaced apart cut-outs formed therein. The intermediate region has opposed relatively flat top and bottom surfaces. Further, the anchor point of the bulbous portion has a flared end section having a plurality of flared legs.

Those of ordinary skill in the art will recognize that the present invention contemplates and can include any combination of the foregoing features or elements.

BRIEF DESCRIPTION OF THE DRAWINGS

These and other features and advantages of the present invention will be more fully understood by reference to the following detailed description in conjunction with the attached drawings in which like reference numerals refer to like elements throughout the different views. The drawings illustrate principals of the invention and, although not to scale, show relative dimensions.

DETAILED DESCRIPTION OF THE INVENTION

Figure 1:
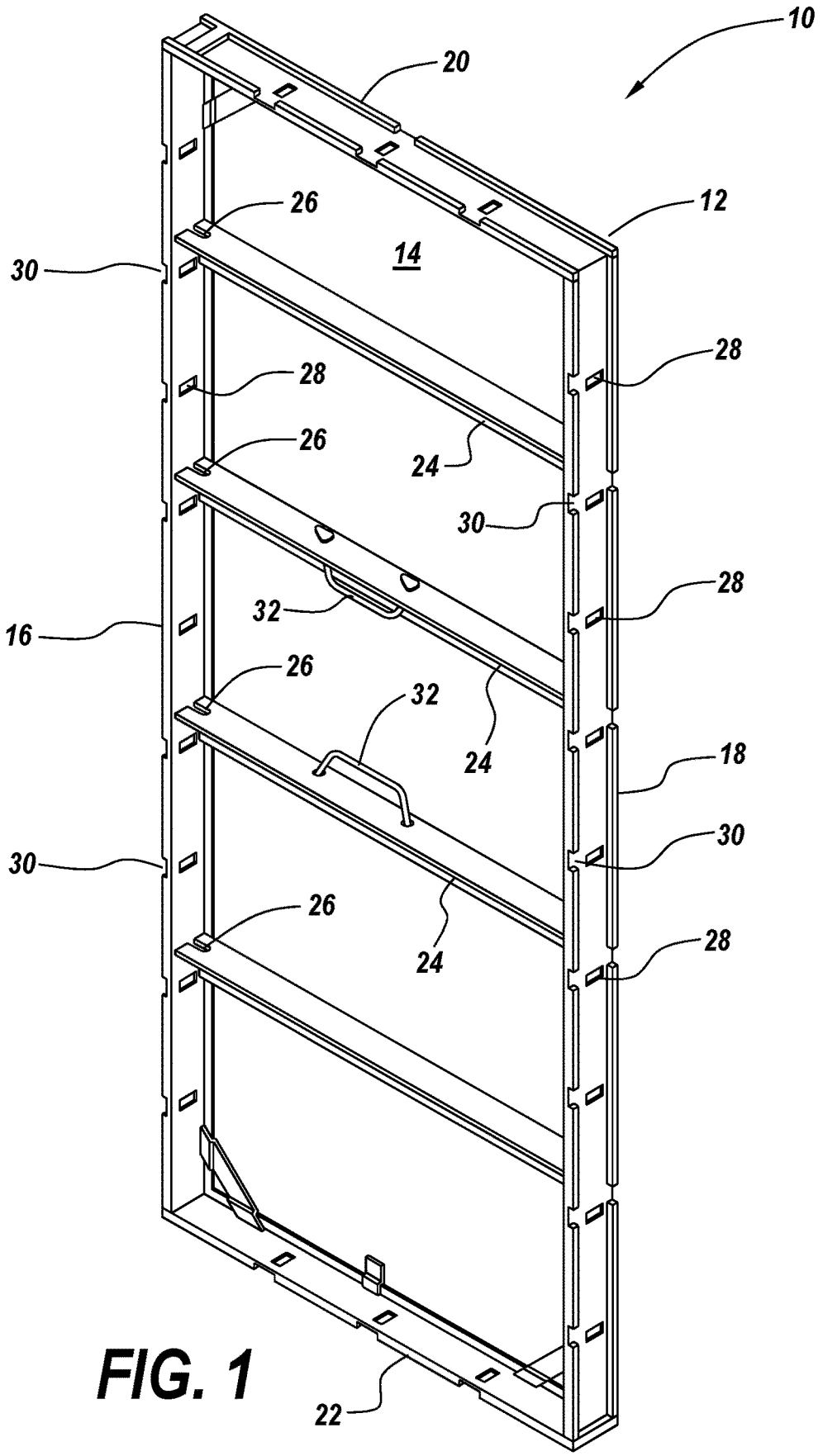
FIG. 1 is a perspective view of a metal, frame based concrete forming system suitable for employing the tie rod of the present invention.
Figure 2:
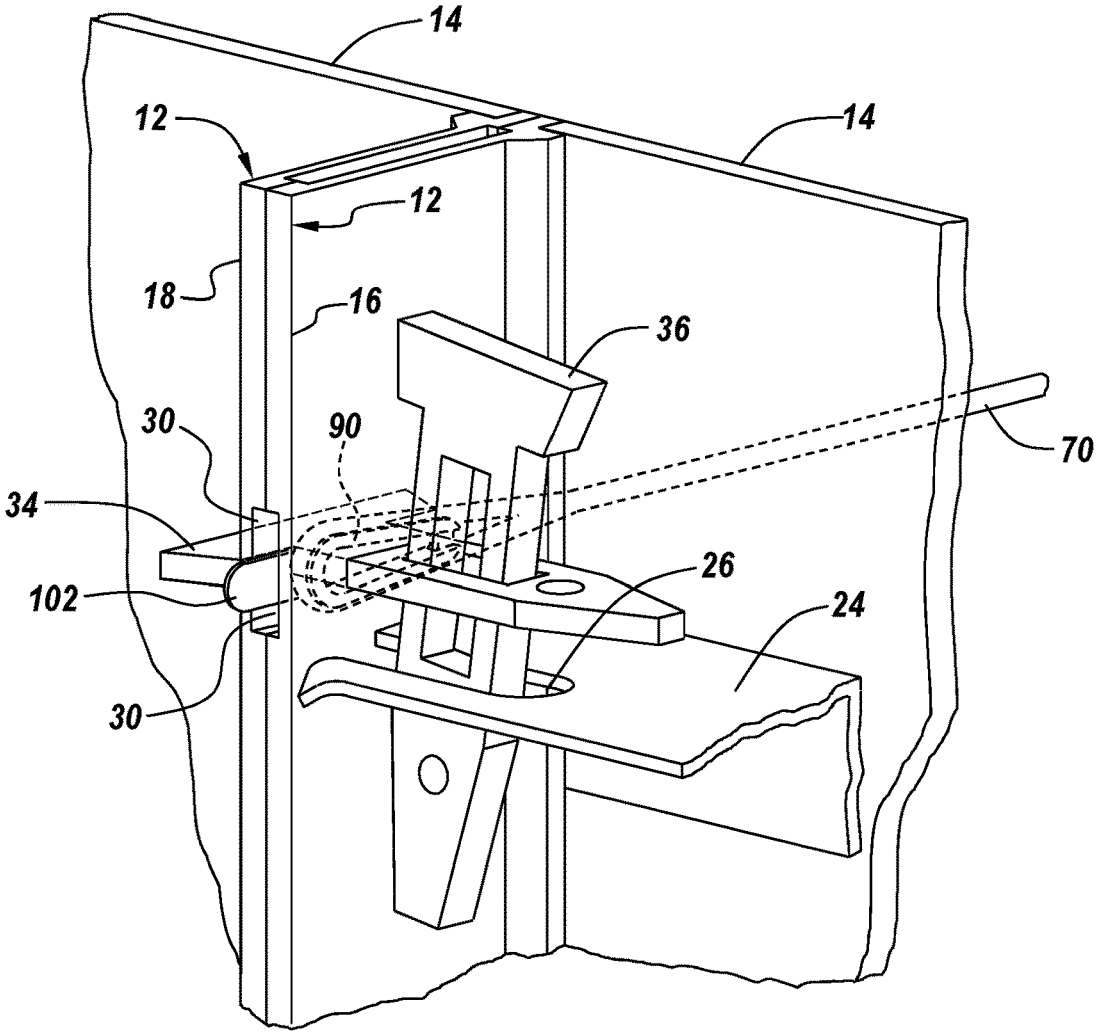
FIG. 2 is partial sectional view of adjacent concrete forming systems employing mounting hardware, such as wedge bolts, and the tie rod of the present invention.
Figure 3:
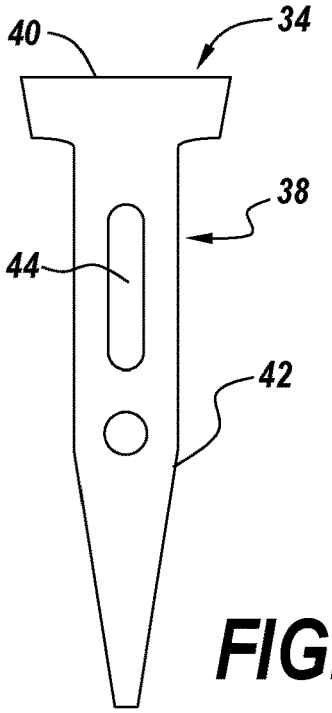
FIG. 3 is a perspective view of the wedge bolt of FIG. 2.

There exists in the art metal, frame-based, panel type concrete forming systems and associated hardware, such as fillers and wedge bolts, for forming concrete walls of any size and shape. An example of a commercially available metal concrete forming system is the Steel-Ply Concrete Forming System from Dayton Superior Corp. The illustrated metal concrete forming system 10 includes a steel frame 12 that can employ a metal or wood facing 14. As shown in FIGS. 1-3, the metal frame 12 has a pair of vertical side rails 16, 18 forming left and right side rails and a pair of horizontal side rails 20, 22 forming the top and bottom rails. Further, a plurality of horizontal cross-members or support rails 24 are formed between the two opposed side rails 16, 18 and help form supports for the frame 12. The cross members 24 also have a cross-member slot 26 formed therein adjacent to the side rails 16, 18. The facing material 14, such as plywood, is attached to one face side of the frame 12. The plywood 14 is typically used to form a smooth finish to the formed concrete wall. The vertical side rails 16, 18 both have side slots 28 formed therein intermittently throughout the length of the side rail. The side slots 28 are adapted to accommodate a securing bolt, such as a wedge bolt, as described further below. Further, the side rails 16, 18 include a plurality of dado slots 30 formed therein adjacent to the side slots 28. Further, certain cross-members 24 can include a handle 32 formed thereon to assist the user in lifting and manipulating the panel.

The metal form panels 12 can be placed adjacent to each other to form the rough outline of the concrete wall to be formed. As shown in FIGS. 2-3, the adjacent panels 12 can be coupled together and to tie rods or ties 70 disposed within the wall to be formed using a lock-bolt set comprising first and second wedge bolts 34, 36, as is known in the art. In the current embodiment and example, the metal framing system employs loop style tie rods or ties. The first and second wedge bolts 34, 36 can be identical if no filler parts are employed or can be differently configured if a filler part is employed, as is known. As shown, each of the wedge bolts 34, 36 has a main body 38 having a head portion 40 and a wedge shaped body 42 extending therefrom. The wedge shaped body 42 has a bolt slot 44 formed therein.

The dado slots 30, 30 formed in the side rails 18, 16 of the adjacent panels form an enclosure that is adapted to accommodate the protruding end of an associated tie rod 70. The tie rod 70 is used to help strengthen the finished wall that is formed. In metal concrete forming systems, the tie rod can be either a loop tie or a flat tie. Conventional metal loop ties have a main body that has a loop formed at both ends. These types of ties can also be conventionally referred to as panel or S-ties. When positioned correctly between opposed forming panels, the loop ends of the tie are positioned between the dado slots 30 and are aligned with the side slots 28 formed in the side rails 16, 18. The first wedge bolt 34, such as a connecting wedge bolt, is slid into the side slot 28 formed in the side rail 16, 18 and through the loop end of the tie. As such, the tapered end of the first wedge bolt 34 and specifically the bolt slot 44 is exposed. The tapered end 42 of the second wedge bolt 36, such as a clamping wedge bolt, is disposed in the bolt slot 44 and also seats within the cross-member slot 26. The clamping bolt helps connect together the adjacent panels and also helps secure the tie rod.

The tie rod 70 is typically disposed between aligned panels in order to keep the panels properly spaced apart and to ensure that the panels are coupled to each other in a secure manner. The tie rod 70 extends through openings formed in the spaced apart form sections or panels and holds the sections against relative movement toward each other. The tie rods may extend outwardly of the concrete walls and if desired outwardly of the form panels by a selected amount, as is known in the art. Once the concrete is poured between the panel forms and allowed to cure, the portion of the tie rods that extend beyond the concrete walls can be removed.

A problem with conventional tie rods is that they can be relatively difficult to position relative to the metal form panels. Further, the portion of the tie rods that extends beyond the formed and cured concrete wall can be difficult to remove, or when snapped off, typically do not break off cleanly from the rest of the tie rod embedded in the wall. Further, in architectural environments where a clean and relatively unmarked wall is important, the use of conventional metal loop or flat ties presents a problem. Currently, the portion of the ties that extend beyond the wall are snapped off or otherwise removed. This removal process may serve to mar the formed concrete wall. Also, the portion of the tie that remains in the wall can be prone to rusting, and hence at a later time can mar the aesthetics of the finished wall. Further, the ties cannot be used in selected applications, such as sites that require non-magnetic features in the walls, such as medical buildings.

To address these and other issues of conventional metal loop ties, the tie rod 70 of the present invention can be formed of a material other than metal. According to one practice, the tie rod is non-metal, and can be made for example from fibers formed of fiberglass, carbon, and para-aramid synthetic fibers such as Kevlar. The material can be coated, if desired, with one or more other materials. For example, the fiber material can be pre-coated, coated as the fiber is wound about the thimble elements 90, or coated after the tie rod is formed using any suitable material. The coating material can be used to bind the fiber winds together or can be used as a curing or hardening agent. The tie rod 70 of the present invention is illustrated in FIGS. 4-12. The illustrated tie rod 70 is a loop style tie rod, although other forms and configurations can be employed consistent with the teachings of the present invention. As shown for example in FIGS. 4-9, the illustrated loop tie rod 70 of the present invention has a main body 72 with a central linear region 74 and has loops 76, 78 formed at opposed ends. The loops 76, 78 can be sized, if desired, to house a reinforcing element, such as thimble element 90. According to an alternate embodiment, the illustrated loop tie rod 70 does not include the thimble element 90. The loop tie rod 70 is preferably formed from a fiberglass material that can be, if desired, coated with a select material, such as a binding material. According to one embodiment, the fiberglass can be pre-coated or coated with any suitable curing or hardening material, such as with an epoxy resin material, such as that commercially available from TCR Composites, USA. The fiberglass is preferably a high strength glass fiber, although other strength types can be used. The fiberglass tie rod of the present invention has low thermal conductivity, and has a thermal expansion coefficient similar to concrete, thus creating a better bond between the tie and concrete, which serves to improve the overall water sealing capability of the tie. The fibers employed in the present invention, such as the fiberglass fibers, exhibit a tensile strength of between about 300K PSI and about 530K PSI. The finished and cured tie rod 70 preferably exhibits a tensile strength of around 6000 PSI. A key feature of the present invention is that the strength of the resultant fiberglass tie rod 70, in use, is able to significantly match the strength of conventional metal loop ties.

Figure 9:
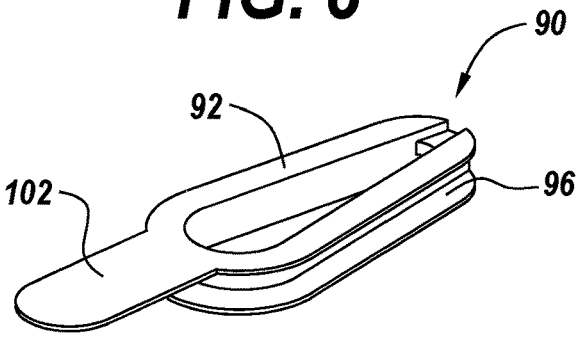
FIG. 9 is a perspective view of the thimble portion of the tie rod of the present invention illustrating the tab portion of the thimble.

The illustrated thimble element 90 has a main body 92 that is shaped in a manner similar to a horse-shoe shape that can have an open or closed end, and preferably has a closed end. The outer peripheral or circumferential edge or surface 94 of the main body has a central channel 96 formed therein. The channel preferably has a thickness or width of between about 0.175 inches and about 0.22 inches, and preferably has a width of about 0.20 inches. The inner surface 98 of the main body has an optional raised edge-like protrusion 100 that forms a fin feature or element. In an alternate embodiment, as shown in FIG. 9, the thimble 90 can include a tab-like protrusion 102 that extends outwardly from the outer surface 94 of the main body 92. According to another practice, the floor of the central channel 96 can have a low friction coating or material applied thereto. For example, the channel can be coated with a polytetrafluoroethylene (PTFE) material or with a polytetrafluoroethylene (PTFE) tape so as to reduce the frictional forces of the thimble 90. Further, the coating also serves to increase the overall strength of the tie rod 70. Alternatively, the thimble main body can be coated with any suitable material, such as with a tin-based material or PTFE. The thimble element 90 of the present invention can be made from any suitable material, including from metal materials, such as from zinc-based alloys (e.g., Zamak 3), steel, aluminum, magnesium alloy, carbon fiber, polytetrafluoroethylene (PTFE), or plastic, or from combinations of these materials.

Figure 4:
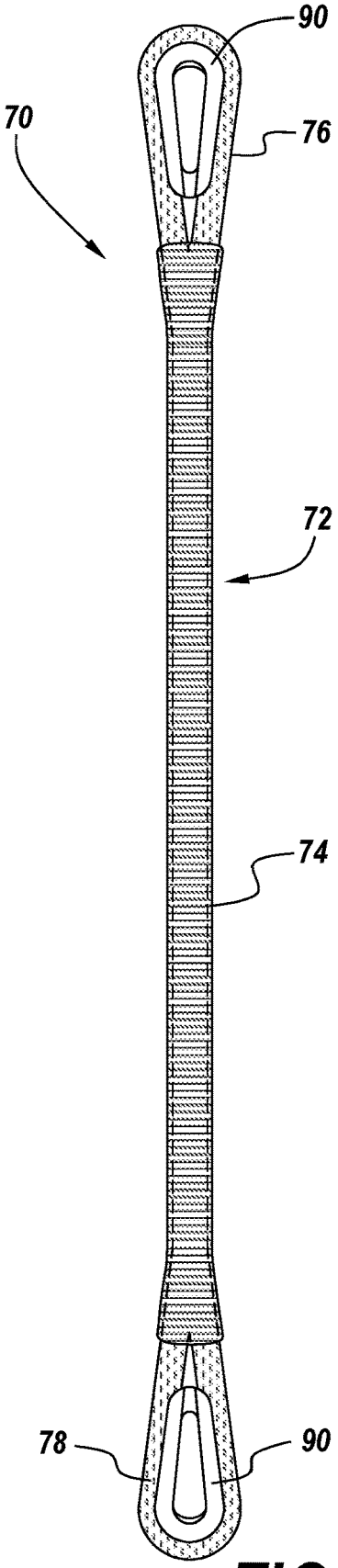
FIG. 4 is a perspective view of the tie rod of the present invention.
Figure 5:
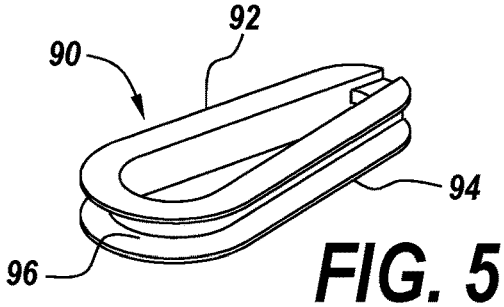
FIGS. 5 and 6 are perspective views of the thimble portion of the tie rod of the present invention.
Figure 6:
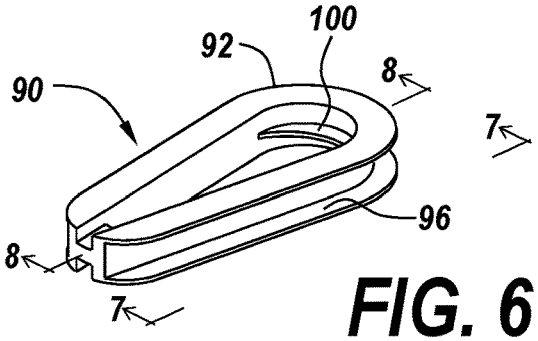
Figure 7:
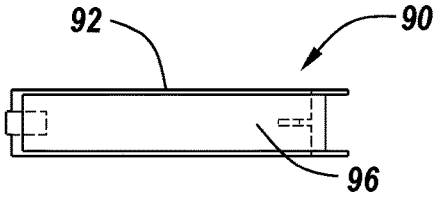
FIG. 7 is a cross-sectional view of the thimble portion of the tie rod of the present invention along line 7-7 of FIG. 6.
Figure 8:
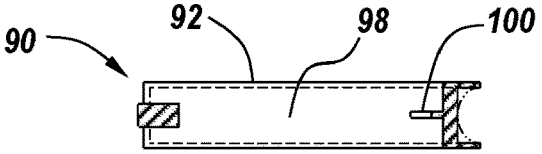
FIG. 8 is a cross-sectional view of the thimble portion of the tie rod of the present invention along line 8-8 of FIG. 6.
Figure 10:
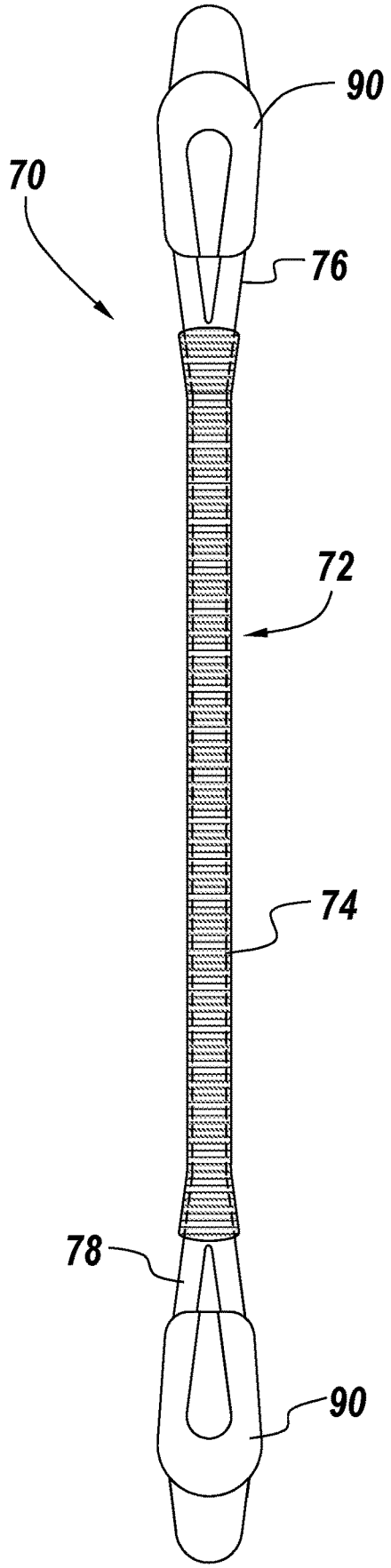
FIG. 10 is a perspective view of the tie rod of the present invention.
Figure 13A:
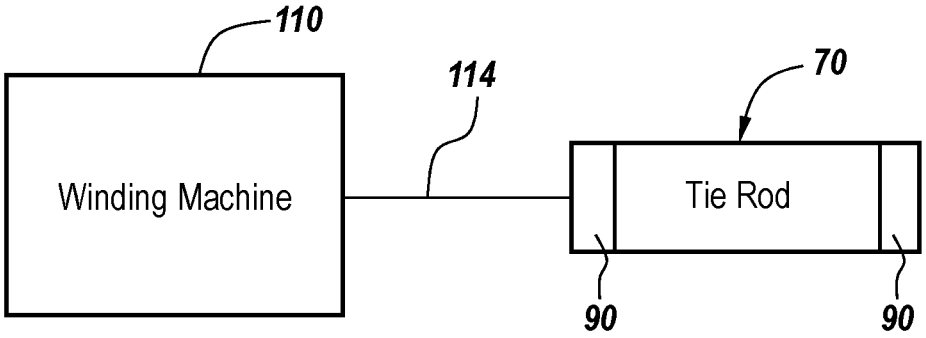
FIG. 13A is a schematic block diagram illustrating the winding machine employed for winding the fiber to create the tie rod of the present invention.
Figure 13B:
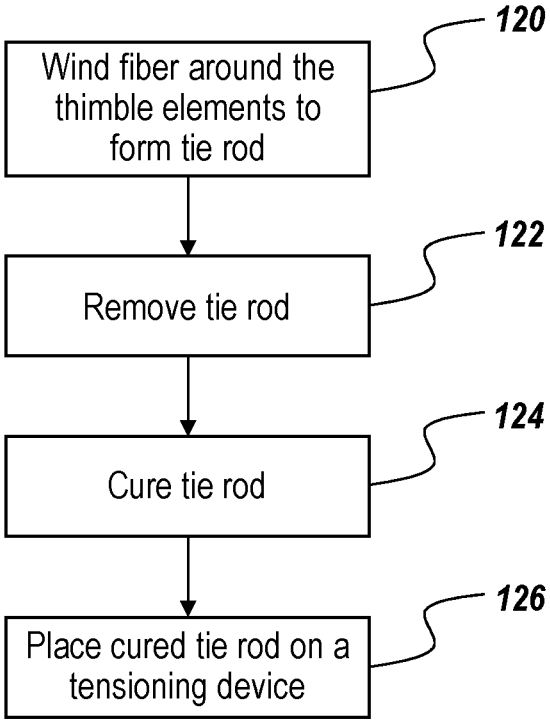
FIG. 13B is a flowchart diagram illustrating the steps for forming the tie rod of the present invention.

The illustrated loop tie rod 70 of the present invention can be formed by winding the fiber 114 (e.g., fiberglass material) using any suitable fiber or filament winding machine 110 about the opposed thimble elements 90. For example, as shown in FIGS. 13A and 13B, the loop tie rod 70 has associated therewith the thimble elements 90, 90. The illustrated fiber 114 can be wound about the thimble elements 90, 90 by the winding machine according to known techniques, step 120. For example, the tie rod 70 can be placed on or coupled to a rotating and/or translational mandrel or support (not shown) and the fiber can be wound, under tension, between the opposed thimble elements. Alternatively, the fiber winding machine 110 can be rotated about the tie rod. The loop tie rod 70 thus includes one or more continuous glass fibers that are wound into the desired shape of the loop tie. When the continuous fiber is wound about the thimbles 90, 90, the fibers are preferably maintained under tension, such as between about 2 lbs and about 10 lbs pressure, and the overwrap tension on the fiber when wound to create the overwrap is between about 5 lbs pressure and about 20 lbs pressure. The fiber is wound about the thimble elements a selected number of times ranging between about 8 times and about 35 times, depending upon the size and yield of the fiber. The fibers are wound between the thimbles until the channel 96 is filled with the fibers. Upon completion, the tie rod can be completed by optionally continuing to wind the fiber to create an optional overwrap in the central region 74 of the tie. As is shown, the number of wraps of the fiber between the thimble elements 90, 90 can be specified such that the fiber fills the channel 96 of the thimble element without extending beyond the confines of the channel. Optionally, the fiber can be wound further until the fiber extends past the confines of the channel 96, as shown in FIG. 4. Alternatively, as shown in FIG. 10, the fiber can wound about the thimbles 90 so as to fill the channel 96 without exceeding the channel height or depth.

The completed loop tie 70 is then removed from the supporting structure, step 122, and then cured by heating by placing the loop tie in any suitable heating device for a selected duration of time and at a selected temperature, step 124. For example, according to one embodiment, the loop tie is cured by being placed in a heating oven for about 1 to about 2 hours, at a temperature of about 250° F. to about 300° F., based on the type of material used. Those of ordinary skill will readily recognize that the time and temperature can vary as a function of the material type used to form the tie. Those of ordinary skill will also recognize that UV-based epoxy resins can also be used, and hence can be cured using UV radiation rather than heat. Once completed, the finished tie can be placed on a tensioning device or frame (not shown) which keeps the cured loop tie under tension so as to align and equalize the fibers for any suitable amount of time, step 126.

The illustrated tab portion 102 of the thimble 90 can help guide the tie rod 70 through the dado slots 30 formed in the form panels 12 when the panels are assembled. Further, the tab portion 102 can provide a visual indication or confirmation that a tie rod 70 is indeed in place when the panels are all assembled, since it projects outwardly beyond the panels on the outside of the wall. Without the tab portion 102, there is no quick and easy way to visually confirm that a tie rod 70 was not missed when installing the panel forms. Those of ordinary skill will readily recognize that not all types of ties, including loop ties, are designed to provide an end portion that will readily pass through the panel forms and extend therebeyond to allow visual confirmation of placement. Thus, the tab extension 102 allows the fiberglass tie rod of the present invention to easily pass through the forms (e.g., the dado slots) and extend past the forms so as to easily viewable by the user.

Figure 11:
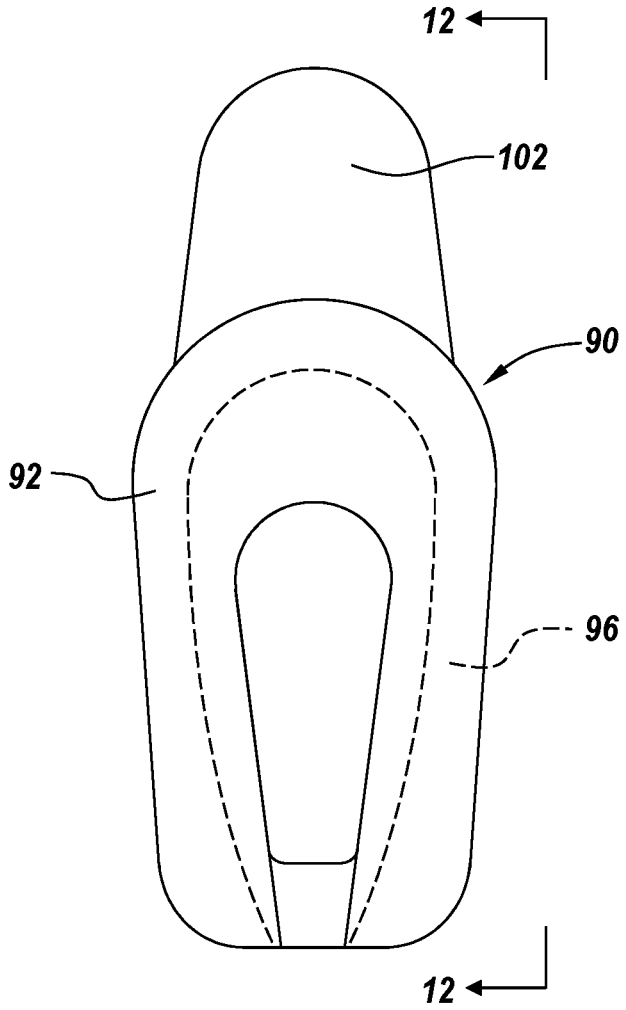
FIG. 11 is a front view of another embodiment of the thimble element of the present invention.
Figure 12:
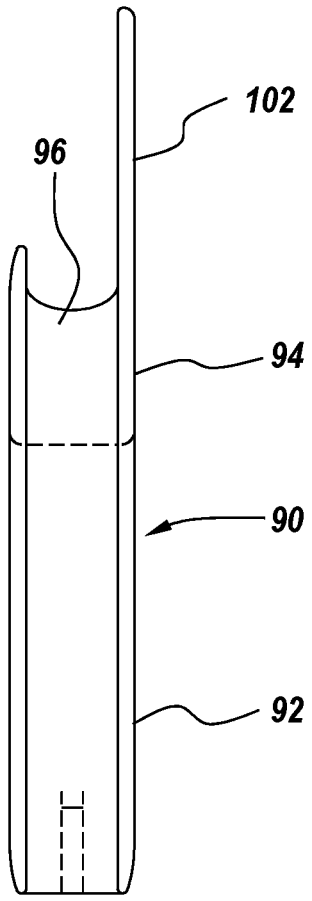
FIG. 12 is a side view of the thimble element of FIG. 11.

Further, the optional ridge or fin element 100 formed along the inner surface 98 of the main body 92 is adapted to bear against the wedge bolt 34, 36 that engages it when assembled in the panel system. The fin element 100 is sized and shaped such that it can deform, that is, give way under load, in a predictable way, manner and rate. In doing so, the fin element 100 allows the tie rod 70 to effectively lengthen to a limited extent, which aids in equalizing the load shared with neighboring tie rods, so that slight variations in length of the tie rods do not subject the shortest tie rod in a group to unwanted and undesirable stresses. Further, the fin element 100 is a visual indicator and can act as forensic evidence of overloading of the tie rod ends of the tie rod 70 in the event of a blowout of the wall when pouring. According to an alternate embodiment, as shown in FIGS. 10-12, the thimble element 90 can be free of the fin element 100 and the main body portion 92 of the thimble element that contacts the wedge bolts 34, 36 or other panel elements can deform at the point of contact, which is usually where the inner portion of the thimble element contacts the wedge bolts in an axial direction. This deformation of the tie rod main body also serves to effectively lengthen the overall length of the tie rod to a limited extent. Further, the tie rod 70 of the present invention can be configured to work with plywood form panel systems, such as Resi-Ply concrete forming systems, and aluminum form panel systems.

Figure 14:
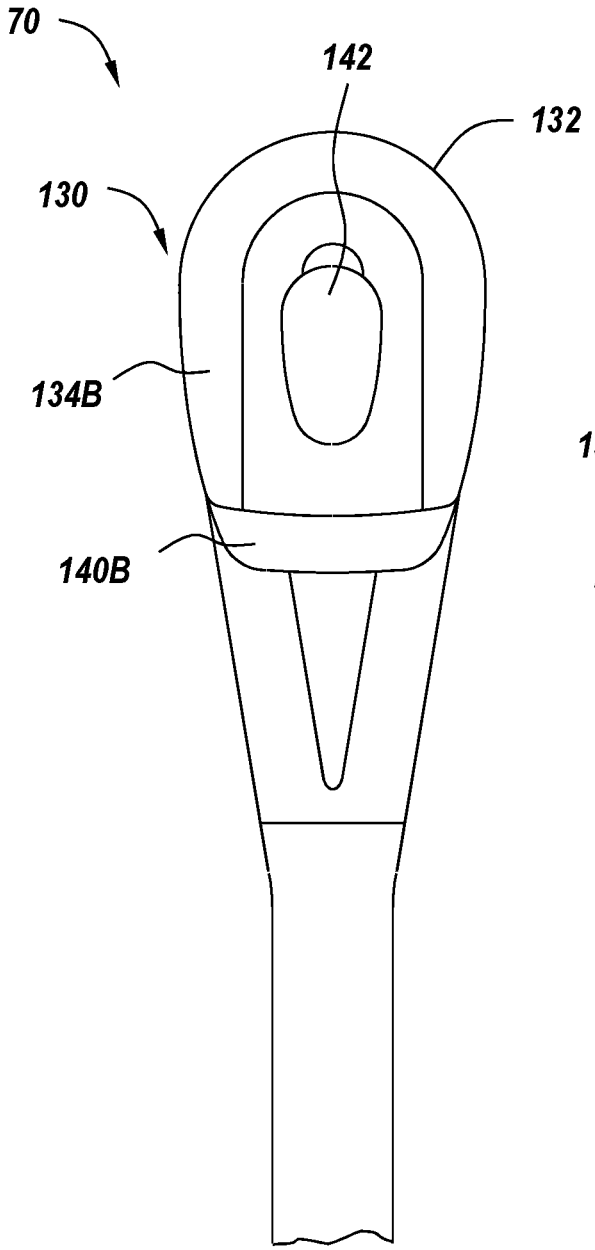
FIG. 14 is a perspective view of another embodiment of the thimble element of the tie rod of the present invention.
Figure 15:
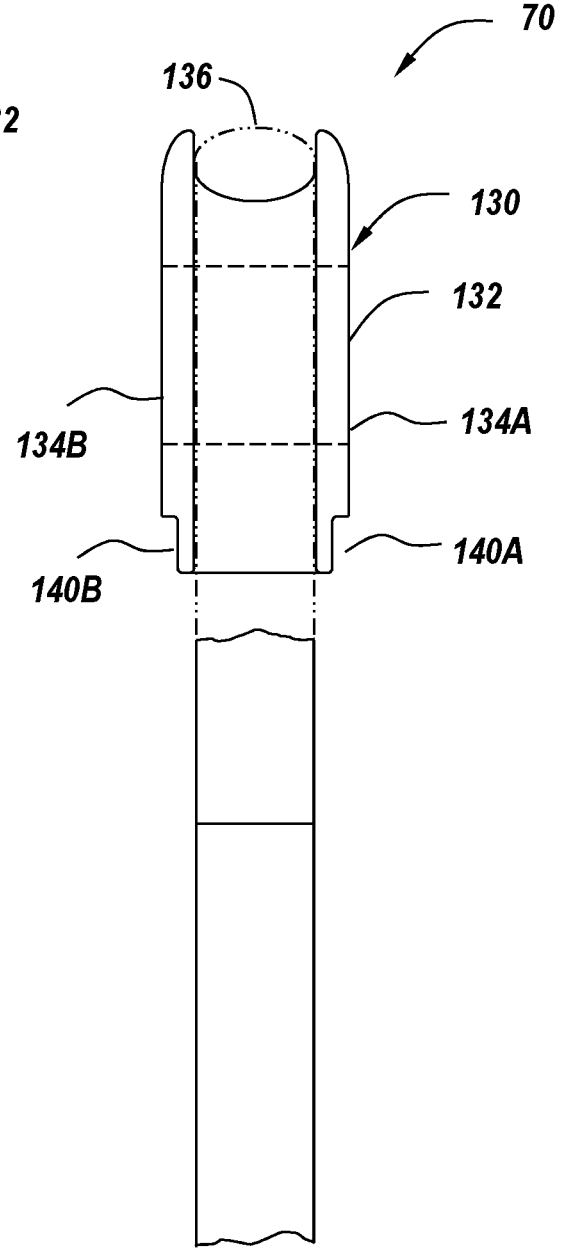
FIG. 15 is a side view of the thimble element of FIG. 14.

The present invention also contemplates the use of tie rods 70 employing differently shaped and configured thimble elements. For example, an alternate embodiment of the tie rod 70 of the present invention is illustrated in FIGS. 14 and 15. Like reference numerals are used throughout to indicate similar or identical structure. According to another embodiment of the invention, the tie rod 70 of the invention can include a pair of opposed thimble elements 130 (only one is shown) that has a main body 132 having a generally horse-shoe shape with a closed end that has a pair of opposed outer surfaces 134A, 134B. The main body 132 forms a central opening 142 that is sized and configured for seating one of the wedge bolts 34, 36. The opposed outer surfaces 134A, 134B have a central channel 136 formed in a peripheral or outer surface of the main body. In addition to the central channel 136, each of the outer surfaces 134A, 134B can have an outer channel 140A, 140B, respectively, formed therein. The outer grooves 140A, 140B are sized and configured for mounting or seating a swing latch element of conventional concrete forming systems, such as the STEEL DOG® form systems commercially available from Titcomb Bros. Mfg.

Figure 16:
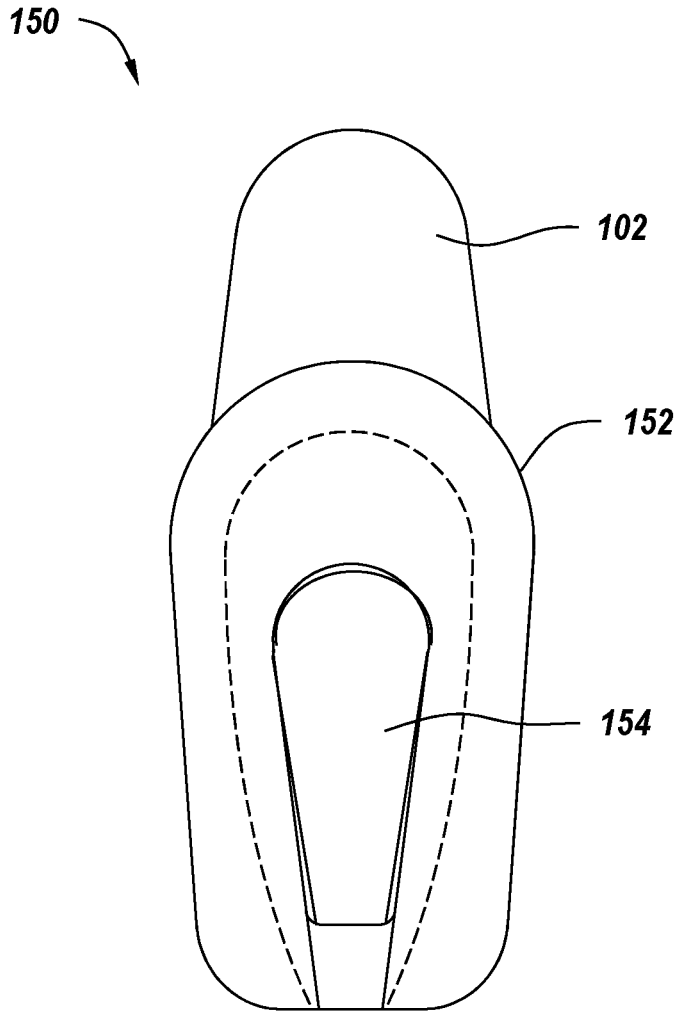
FIG. 16 is a perspective view of yet another embodiment of the thimble element according to the teachings of the present invention.
Figure 17:
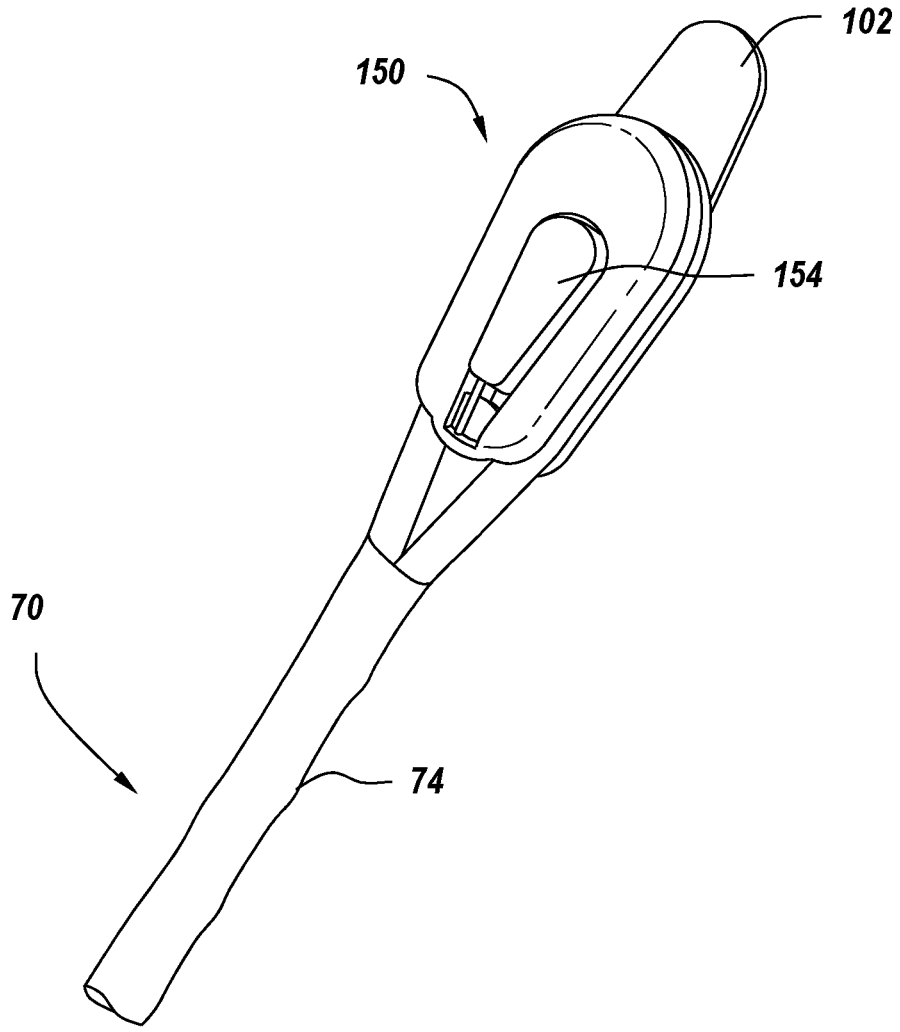
FIG. 17 is a perspective view of the thimble element of FIG. 16 as part of the tie rod according to the teachings of the present invention.
Figure 18:
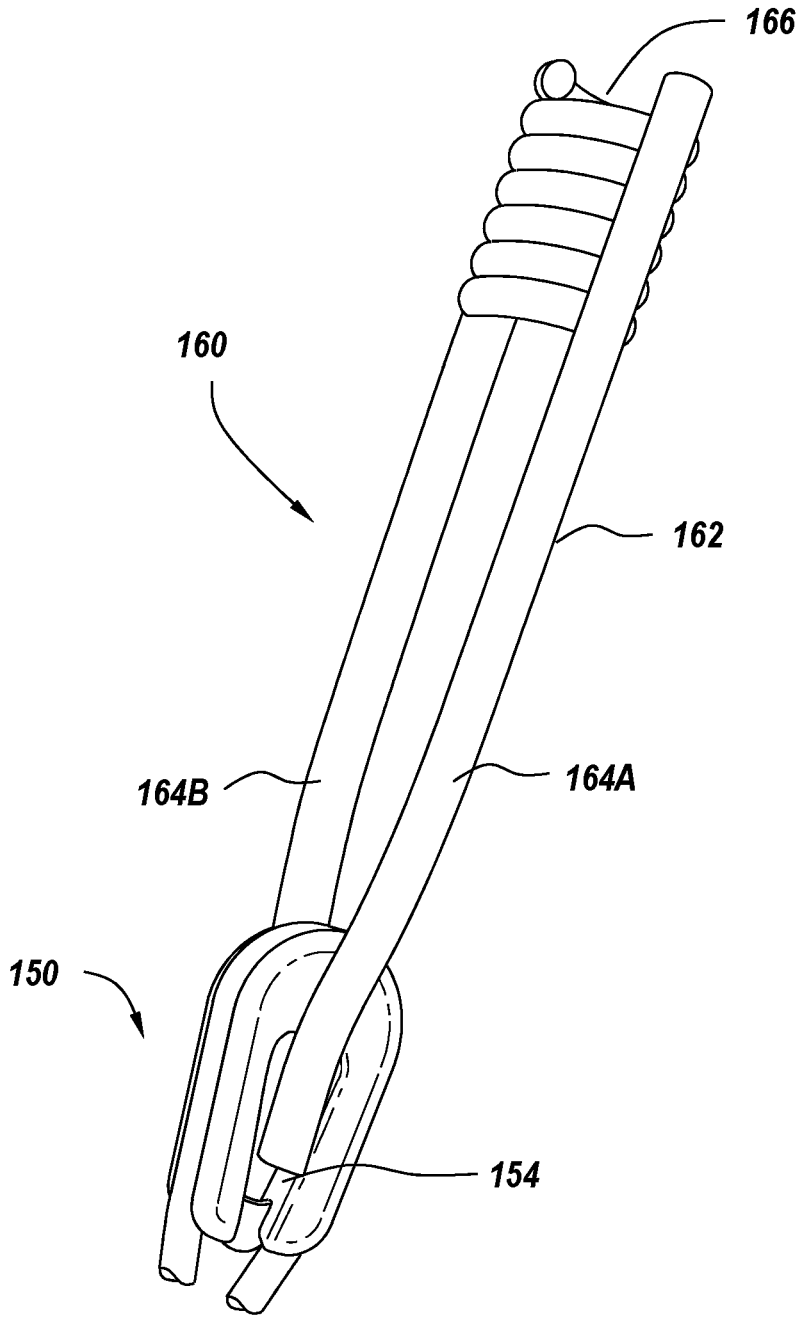
FIG. 18 is a perspective view of the thimble element of FIG. 16 as part of the tie rod and attached to transition hardware according to the teachings of the present invention.
Figure 19:
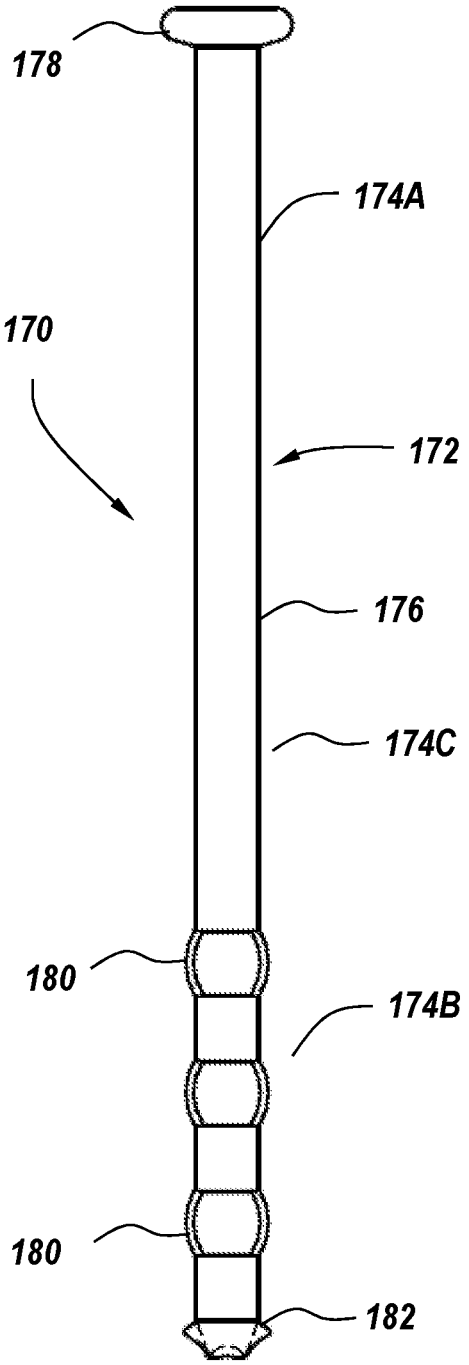
FIG. 19 is a top view of a button rod element suitable for use with the tie rod according to the teachings of the present invention.
Figure 20:
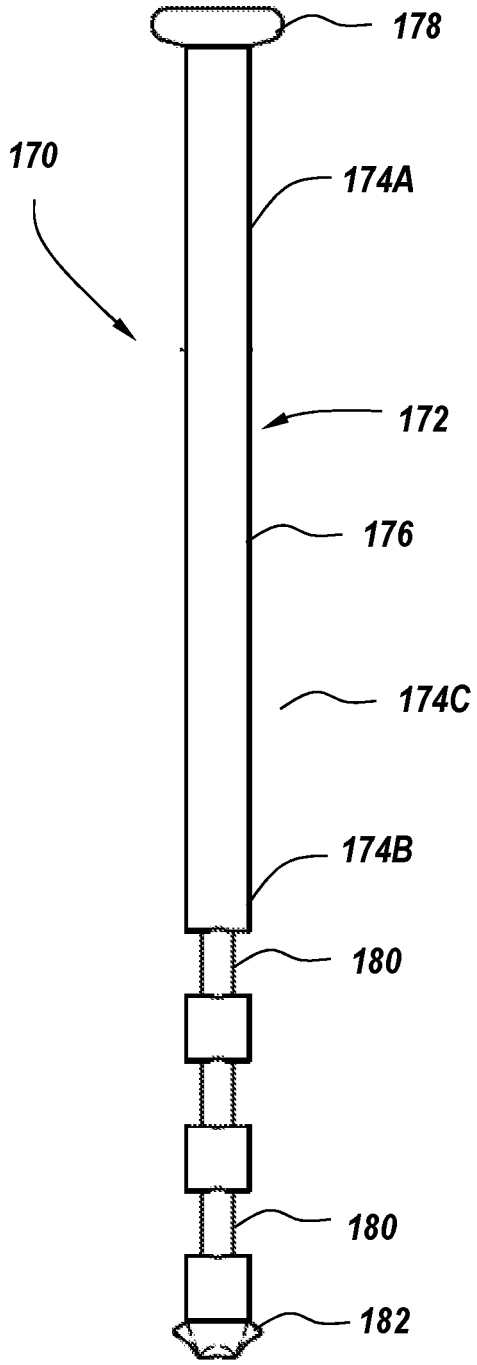
FIG. 20 is a side view of the button rod element of FIG. 19 suitable for use with the tie rod of the present invention.
Figure 21:
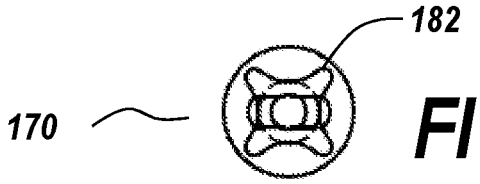
FIG. 21 is an end view of the button rod element of FIG. 19 suitable for use with the tie rod of the present invention.
Figure 22:
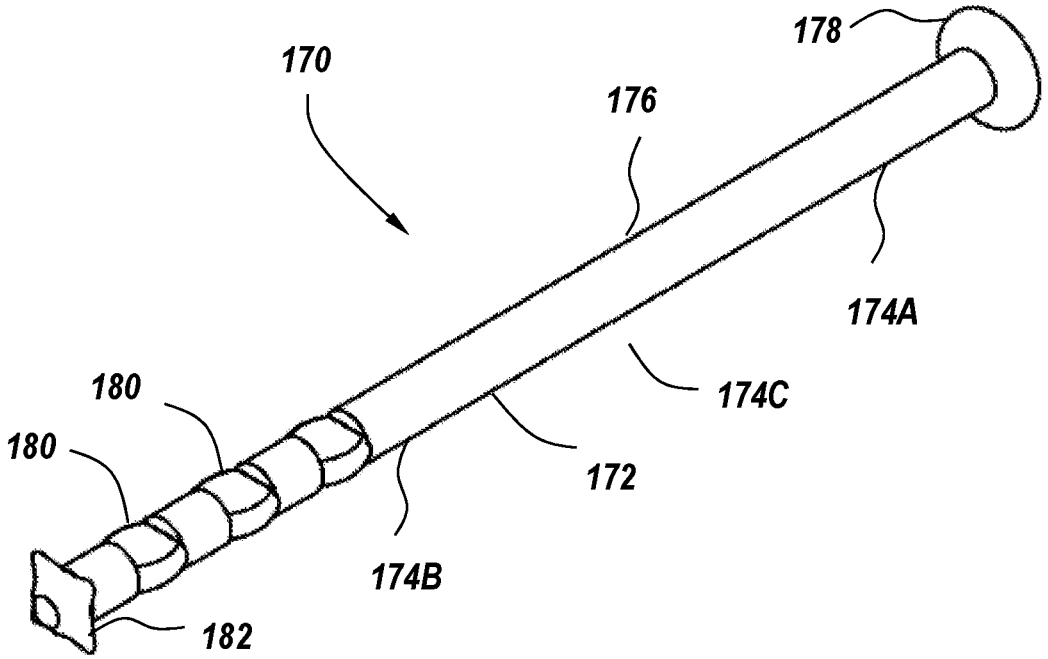
FIG. 22 is a perspective view of the button rod element of FIG. 19 suitable for use with the tie rod of the present invention.
Figure 23:
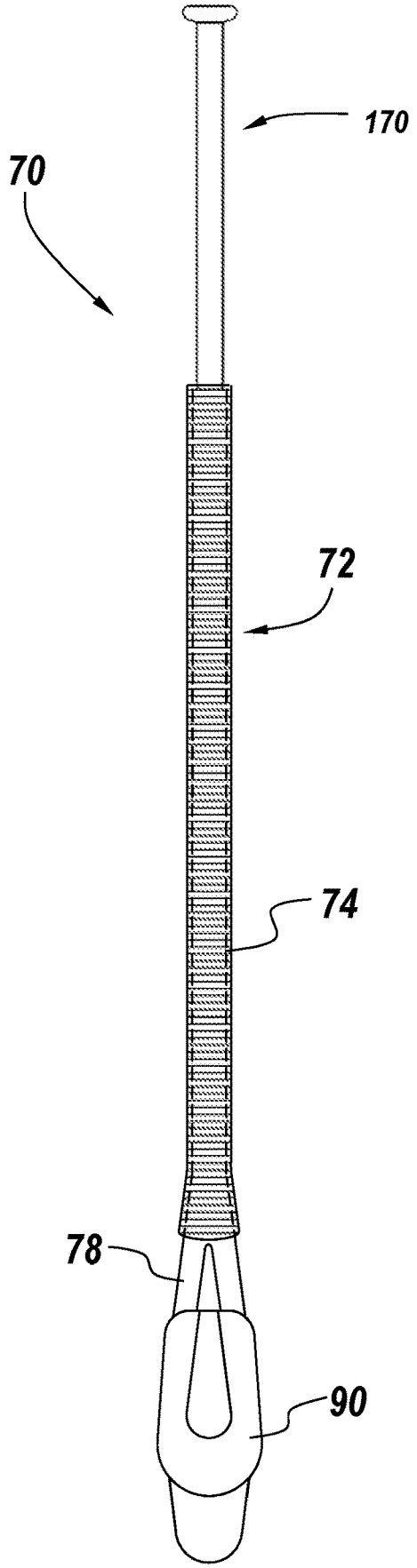
FIG. 23 is a perspective view of the tie rod of the present invention employing different types of structure at the end regions, including for example a thimble element and a button rod element, according to the teachings of the present invention.
Figure 24:
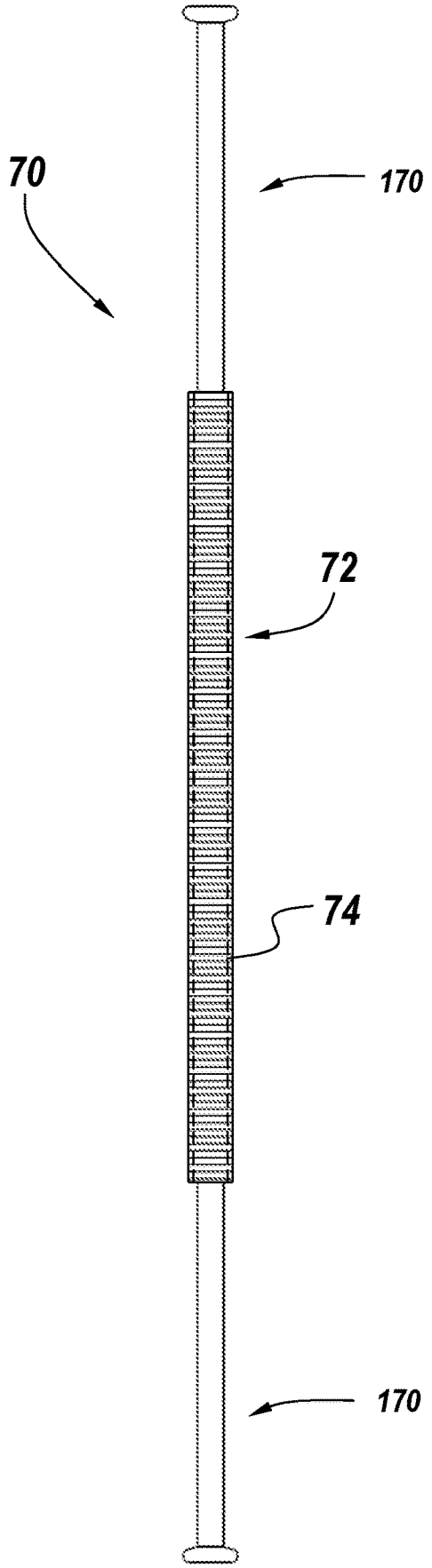
FIG. 24 is a perspective view of the tie rod of the present invention employing button rod elements at the end regions according to the teachings of the present invention.
Figure 25:
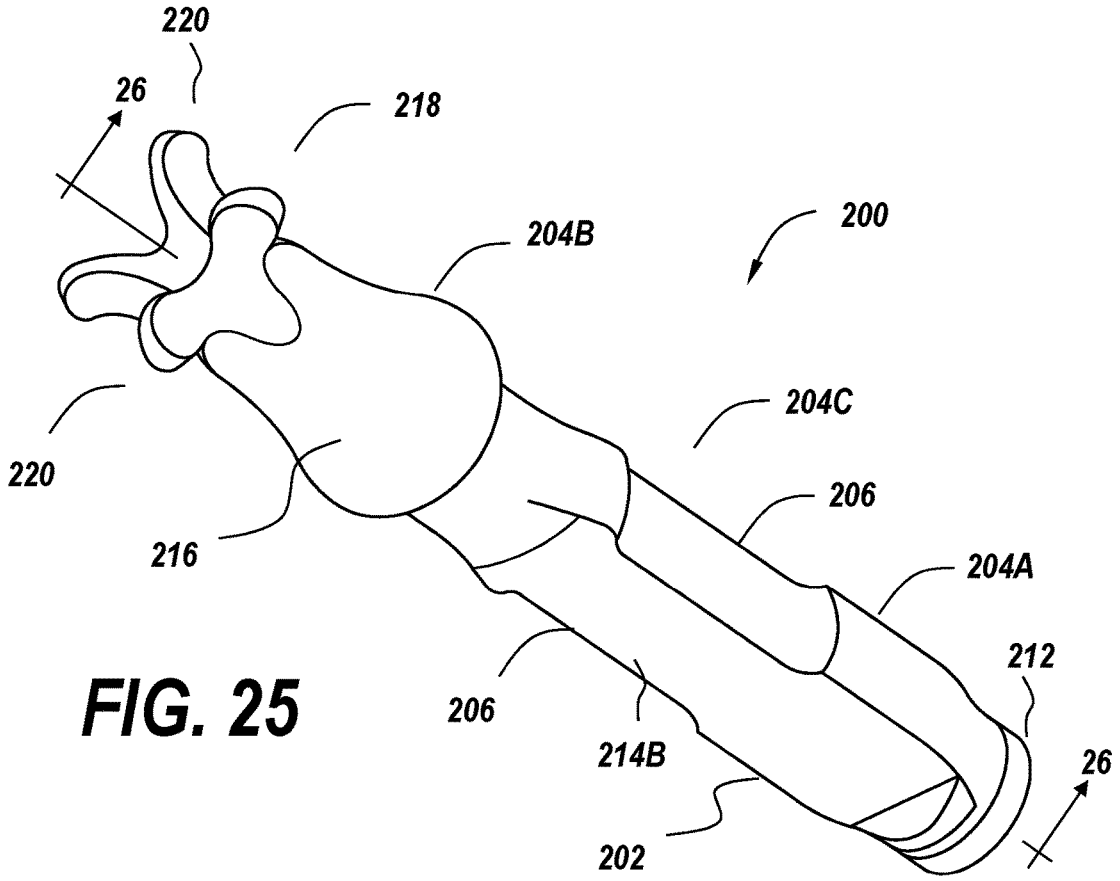
FIG. 25 is a perspective view of another embodiment of the button rod element suitable for use with the tie rod of the present invention.
Figure 26:
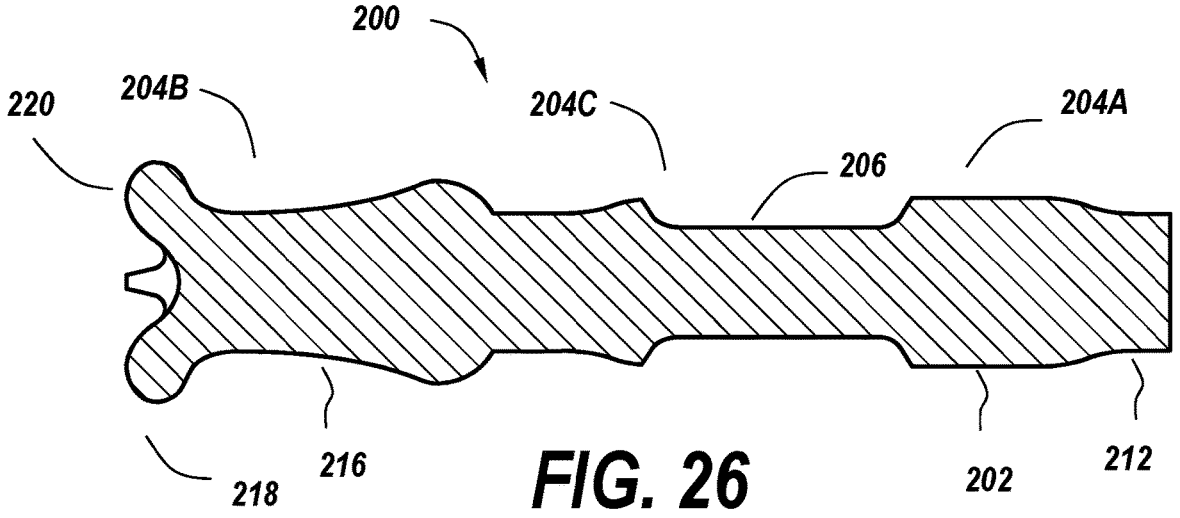
FIG. 26 is a cross-sectional view of the button rod element of FIG. 25 taken along line 26-26 according to the teachings of the present invention.
Figure 27:
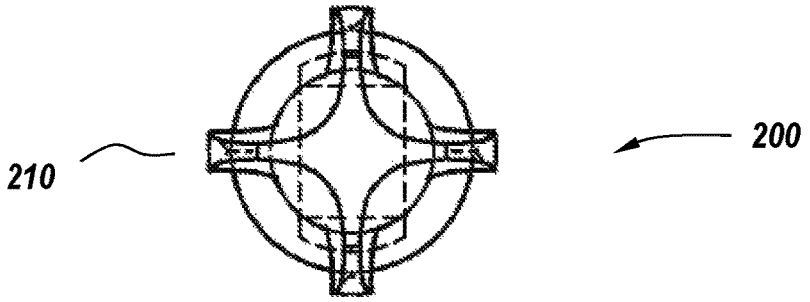
FIG. 27 is an end view of the button rod element of FIG. 25 according to the teachings of the present invention.
Figure 28:
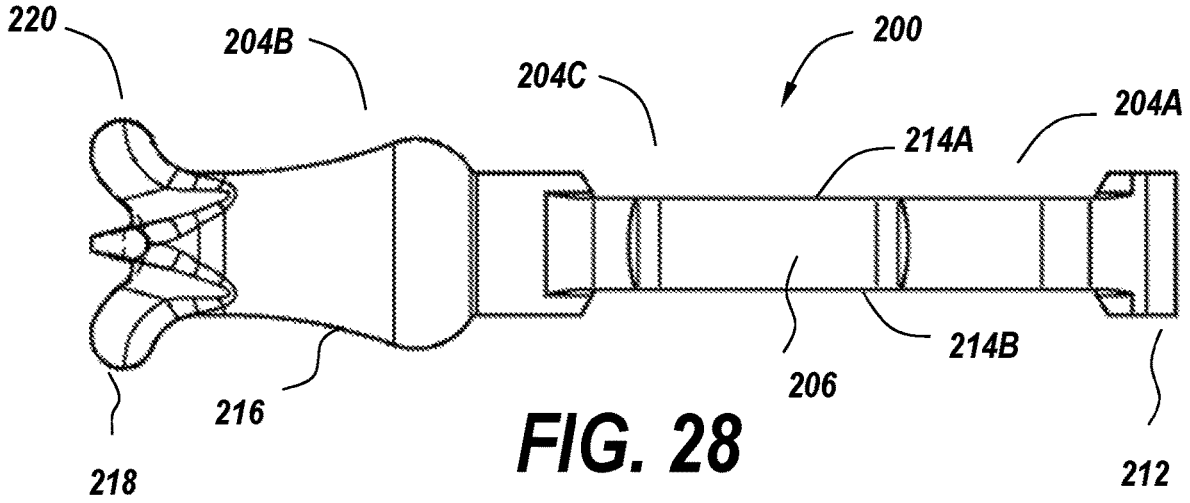
FIG. 28 is a side view of the button rod element of FIG. 25 according to the teachings of the present invention.
Figure 29:
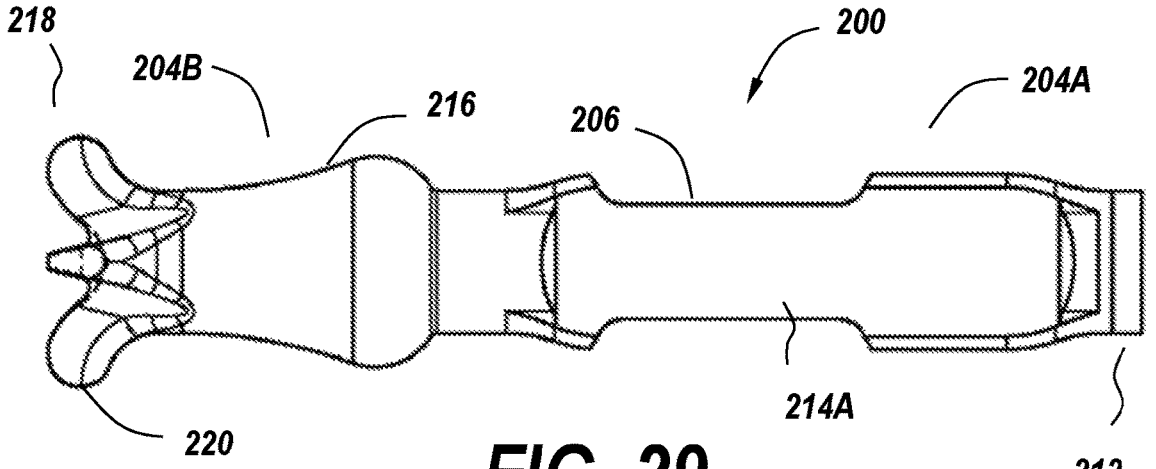
FIG. 29 is a top view of the button rod element of FIG. 25 according to the teachings of the present invention.

FIGS. 16-18 illustrate yet another embodiment of the thimble element of the present invention. Like reference numerals are used throughout to indicate similar or identical structure. The illustrated thimble element 150 includes a main body 152 having a tab portion 102 formed thereon and which extends outwardly from the main body 152. The main body 152 can have a central opening, similar to thimble elements 70, 130, or can have a solid component 154 that fills the opening, as illustrated. The solid component 154 can be secured within the thimble 150 according to known techniques. Alternatively, the solid component 154 can be integrally formed with the main body 152 of the thimble element 150. The solid element 154 can be used to secure one or more types of transition hardware to the thimble element, and hence to the tie rod 150. For example, a coil tie element 160 can be secured or coupled to the tie rod 70 by way of the solid component 154. The illustrated coil tie 160 includes a main body 162 that has a pair of opposed leg portions 164A, 164B having a bottom portion that are attached to the solid component 154 according to known techniques, such as for example by welding. An example of a suitable coil tie are the STEEL DOG® coil ties commercially available from Titcomb Bros. Mfg. The top portion of the leg portions 164A, 164B are flared outwardly and are attached to an elongated coil element 166. The coil element 166 can be coupled or secured to other types of hardware, as is known in the art. For example, the coil element 166 can be coupled to tie rods by way of the wound fiber such as fiberglass, according to the above techniques.

The tie rod 70 of the present invention can also include at the opposed ends other types of hardware components in addition to or instead of the thimble elements. For example, as shown in FIGS. 19-24, the tie rod can employ button rods 170 at one or more of the opposed ends of the tie rod 70. The illustrated button rods 170 has an elongated main body 172 that has a top end region 174A, an opposed bottom end region 174B, and intermediate region 174C. The main body has a main shaft 176 that has a head portion 178 formed at the top end region 174A. The bottom end region 174B of the main shaft 176 includes a chamfered region that has a plurality of alternating spaced apart cut-outs 180 that are flattened in a selected plane. Specifically, the cut-outs are spaced apart along the main axis of the rod element. The bottom end region 174B has an anchor portion that is formed as a star pointed end 182, which serves as an anchor point. The fiber can be wound about the chamfered region and specifically about the cut-outs 180 and the star pointed end 182 so as to bind to the main shaft 176, according to known techniques. For example, the fiber can be wound about the button rod 170 using the winding machine 110 and by rotating the button rod so as to expose alternating cut-outs 180 and alternating portions of the star pointed end 182. The tie rod 70 of the present invention can employ a button rod 170 at one end and a thimble element at the other end, FIG. 23, or can employ the button rod 170 at both ends, FIG. 24.

FIGS. 25-29 illustrate another embodiment of the button rod element 200 of the present invention. The illustrated button rod 200 has a generally elongated main body 202 that has a first or top end region 204A, a second or bottom end region 204B, as well as an intermediate region 204C. The top end region 204A includes a head element 212. The intermediate region 204C includes a pair of spaced apart cut-outs 206, 206 formed in side surfaces thereof, and has relatively flat top and bottom surfaces 214A and 214B, respectively. The cut-outs are preferably radially spaced apart relative to a width of the main body. The bottom end region 204B includes a rose-hip section that has a relatively bulbous portion 216 that tapers to an end portion and terminates in a flared section 218 having a plurality of flared legs 220 that form anchor portion. The fiber can be wound about the intermediate region 204C and/or the bottom end region 204B, and specifically about the cut-outs 206 and the flared legs 220 of the flared section 218 so as to bind to the main body 202, according to known techniques. For example, the fiber can be wound about the button rod 200 using the winding machine 110 and by rotating the button rod so as to expose alternating cut-outs 206 and alternating legs 220 of the flared section 218. The tie rod 70 of the present invention can employ one or more of the thimble elements 90, 130, 150, the button rod 170, or the button rod 200, or any combination thereof.

The foregoing description may provide illustration and description of various embodiments of the invention, but is not intended to be exhaustive or to limit the invention to the precise form disclosed. Modifications and variations of the tie rod of the present invention may be possible in light of the above teachings or may be acquired from practice of the invention. For example, while a series of acts has been described above, the order of the acts may be modified in other implementations consistent with the principles of the invention. Further, non-dependent acts may be performed in parallel.

In addition, one or more implementations consistent with principles of the invention may be implemented using one or more devices and/or configurations other than those illustrated in the Figures and described in the Specification without departing from the spirit of the invention. One or more devices and/or components may be added and/or removed from the implementations of the figures depending on specific deployments and/or applications. Also, one or more disclosed implementations may not be limited to a specific combination of hardware. Furthermore, certain portions of the invention may be implemented as logic that may perform one or more functions. This logic may include hardware, such as hardwired logic, an application-specific integrated circuit, a field programmable gate array, a microprocessor, software, or a combination of hardware and software.

No element, act, or instruction used in the description of the invention should be construed critical or essential to the invention unless explicitly described as such. Also, as used herein, the article "a" is intended to include one or more items. Where only one item is intended, the term "a single" or similar language is used. Further, the phrase "based on," as used herein is intended to mean "based, at least in part, on" unless explicitly stated otherwise. In addition, the term "user", as used herein, is intended to be broadly interpreted to include, for example, an electronic device (e.g., a workstation) or a user of an electronic device, unless otherwise stated.

Further, the invention can be employed using any combination of features or elements as described above, and are not limited to the current recited steps or features.

It is intended that the invention not be limited to the particular embodiments disclosed above, but that the invention will include any and all particular embodiments and equivalents falling within the scope of the following appended claims.

The invention claimed is:

1. A tie rod suitable for use with a concrete forming system, comprising one or more thimble elements, wherein the one or more thimble elements has a main body having opposed first and second surfaces, a central channel formed along an outer peripheral surface of the main body, and wherein each of the first and second outer surfaces has an outer channel formed therein, a continuous fiber wound about the thimble element to form the tie rod, wherein the thimble element is disposed at a first end of the tie rod and the continuous fiber is disposed within the central channel when wound thereabout, and a button rod element disposed at a second end of the tie rod, wherein the button rod element has a main body having a first end region having a head portion, an opposed second end region having an anchor point, and an intermediate region, wherein the second end region or the intermediate region has a plurality of spaced apart cut-outs formed therein.

2. The tie rod of claim 1, wherein the main body of the tie rod has a generally horse-shoe shape.

3. The tie rod of claim 2, wherein the main body has a closed end region.

4. The tie rod of claim 1, wherein the main body has a tab portion that extends outwardly therefrom from one end of the one or more thimble elements.

5. The tie rod of claim 4, wherein the tab portion is located at a position opposite a closed end of the main body.

6. The tie rod of claim 1, wherein the fiber is wound about the one or more thimble elements a selected number of times ranging between about 8 times and about 35 times.

7. The tie rod of claim 2, wherein the main body of the one or more thimble elements has a central opening.

8. The tie rod of claim 7, wherein the central opening mounts a solid component.

9. The tie rod of claim 8, further comprising a coil tie mounted to the solid component.

10. The tie rod of claim 1, further comprising a second thimble element disposed at a second end of the tie rod.

11. The tie rod of claim 1, wherein each of the cut-outs has a relatively flat top surface.

12. The tie rod of claim 1, wherein each of the cut-outs has a relatively flat bottom surface.

13. The tie rod of claim 1, wherein the anchor point of the second end region terminates in a star pointed end region.

14. The tie rod of claim 1, wherein the button rod element has a main body having a first end region, an opposed second end region having a bulbous portion having an anchor point, and an intermediate region having one or more cut-outs formed therein.

15. The tie rod of claim 14, wherein the intermediate region has opposed relatively flat top and bottom surfaces.

16. The tie rod of claim 14, wherein the anchor point of the bulbous portion has a flared end section having a plurality of flared legs.

17. A tie rod suitable for use with a concrete forming system, comprising one or more button rod elements, wherein the button rod element has an elongated main body having a first end region having a head portion, an opposed second end region having an anchor portion, and an intermediate region, wherein the second end region or the intermediate region has one or more relatively flat cut-outs formed therein, a continuous fiber wound about the button rod element to form the tie rod, wherein the button rod element is disposed at a first end of the tie rod and the continuous fiber is wound about and attached to the anchor position and the cut-outs, wherein the anchor portion of the second end region includes a star pointed end region.

18. The tie rod of claim 17, wherein the main body of the button rod element has a plurality of spaced apart cut-outs formed therein.

19. The tie rod of claim 18, wherein each of the plurality of cut-outs has a relatively flat top surface.

20. The tie rod of claim 19, wherein each of the plurality of cut-outs has a relatively flat bottom surface.

* * * * *